US006125167A

United States Patent [19]

Morgan

[11] Patent Number: 6,125,167

[45] Date of Patent: Sep. 26, 2000

[54] ROTATING ANODE X-RAY TUBE WITH MULTIPLE SIMULTANEOUSLY EMITTING FOCAL SPOTS

[75] Inventor: Hugh T. Morgan, Highland Heights, Ohio

[73] Assignee: Picker International, Inc., Highland Heights, Ohio

[21] Appl. No.: 09/200,656

[22] Filed: Nov. 25, 1998

[51] Int. Cl.[7] ..... H01J 35/26

[52] U.S. Cl. ..... 378/124; 378/121; 378/134; 378/144

[58] Field of Search ..... 378/121, 124, 378/134, 144, 143

[56] References Cited

U.S. PATENT DOCUMENTS

| | | | |
|---|---|---|---|
| 2,350,642 | 6/1944 | Schwarter | 378/124 |
| 2,900,542 | 8/1959 | McEuen | 378/109 |
| 3,919,559 | 11/1975 | Stevens | 250/508 |
| 4,250,425 | 2/1981 | Gabbay et al. | 378/125 |
| 4,321,473 | 3/1982 | Albert | 250/505 |
| 4,340,816 | 7/1982 | Schott | 378/22 |
| 4,340,818 | 7/1982 | Barnes | 250/509 |
| 5,200,985 | 4/1993 | Miller | 378/135 |
| 5,241,577 | 8/1993 | Burke et al. | 378/135 |
| 5,268,955 | 12/1993 | Burke et al. | 378/135 |
| 5,274,690 | 12/1993 | Burke et al. | 378/135 |
| 5,291,538 | 3/1994 | Burke et al. | 378/135 |
| 5,305,363 | 4/1994 | Burke et al. | 378/4 |
| 5,335,255 | 8/1994 | Seppi et al. | 378/4 |
| 5,485,493 | 1/1996 | Heuscher et al. | 378/686 |
| 5,592,523 | 1/1997 | Tuy et al. | 378/19 |
| 5,625,661 | 4/1997 | Oikawa | 378/15 |

FOREIGN PATENT DOCUMENTS

3109100A1 9/1982 Germany .

*Primary Examiner*—David P. Porta
*Assistant Examiner*—Allen C. Ho
*Attorney, Agent, or Firm*—Fay, Sharpe, Fagan, Minnich & McKee, LLP

[57] ABSTRACT

An x-ray tube (10) includes a body (16) defining a vacuum envelope. A plurality of anode elements (18) each defining a target face are rotatably disposed within the vacuum envelope. Mounted within the vacuum envelope, a plurality of cathode assemblies (22) are each capable of generating an electron stream (36) toward an associated target face. A filament current supply (32) applies a current to each of the cathode assemblies, and is selectively controlled by a cathode controller (34) which powers sets of the cathodes based on thermal loading conditions and a desired imaging profile. A collimator (C) is adjacent to the body and defines a series of alternating openings (42) and septa (44) for forming a corresponding series of parallel, fan-shaped x-ray beams or slices (46).

19 Claims, 6 Drawing Sheets

ROTATING ANODE X-RAY TUBE WITH MULTIPLE SIMULTANEOUSLY EMITTING FOCAL SPOTS

BACKGROUND OF THE INVENTION

The present invention relates to the high power x-ray tube arts. It finds particular application in conjunction with x-ray tubes for CT scanners and will be described with particular reference thereto. It is appreciated, however, that the invention will also find application in conjunction with other types of high power vacuum tubes.

In early x-ray tubes, electrons from a cathode filament were drawn at a high voltage to a stationary target anode. The impact of the electrons caused the generation of x-rays as well as significant thermal energy. As higher power x-ray tubes were developed, the thermal energy became so large that extended use damaged the anode.

Today, one of the principal ways to distribute the thermal loading and reduce anode damage is to rotate an anode. The electron stream is focused near a peripheral edge of the anode disk. As the anode disk rotates, the focal spot or area on the anode disk where x-rays are generated moves along an annular path or footprint. Each spot along the annular path is heated to a very high temperature as it passes under the electron stream and cools as it rotates around before returning for the generation of additional x-rays. However, if the path of travel around the anode is too short, i.e. the anode diameter is too small, or the exposure time is too long, the target area on the anode can still contain sufficient thermal energy that the additional thermal energy from again passing under the electron stream causes thermal damage to the anode surface. Because the anode is in a vacuum, dissipation of heat is retarded and thermal energy stored in the anode tends to build with each rotation of the anode. With the advent of volume CT scans, longer exposure times are becoming more prevalent.

A volume CT scan is typically generated by rotating an x-ray tube around an examination area while a couch moves a subject through the examination area. Presently, greater scan volumes at higher powers are increasingly valuable diagnostically. This diagnostic pressure has, over time, resulted in anodes of progressively larger diameter and mass which provide a longer focal spot path and allow the anode more time to dissipate the additional heat energy. Unfortunately, increasing the length of the focal spot path by increasing the diameter of a single anode requires physically larger x-ray tubes. These bigger tubes have more mass and require more space and peripheral cooling equipment in the already cramped gantry.

It is known to collimate x-rays from a single focal spot into two or more planes of radiation. One drawback of this technique is that the planes are not parallel. Further, only a small number of planes are generated. Several revolutions are needed to traverse a diagnostically significant volume.

Large diameter fixed anode x-ray tubes have been designed with multiple focal spots paths. Multiple slices are obtained sequentially by electrostatically driving an electron stream produced by a single electron gun onto, and around, a series of stationary target anode rings. The anodes are very large, on the order of a meter or more which requires elaborate vacuum constructions. Because the x-ray beams are produced sequentially only a single slice is generated at a time.

Still other systems have been proposed which use a plurality of x-ray tubes within a common CT gantry.

In another approach, a plurality of focal spots are generated concurrently on a single rotating anode. The resultant x-rays are collimated into plural parallel beams. However, multiple concurrent focal spots on a common anode multiply the thermal loading problems. See U.S. Pat. No. 5,335,255 to Seppi, et al.

In another volume imaging technique, the x-rays are collimated into a cone beam. A two dimensional detector grid detects the x-rays to provide attenuation data for reconstruction into a volume image representation. However, x-ray scatter and reconstruction artifacts are problematic with cone beam geometry.

Thus, a simpler and/or better method and system capable of generating a volume scan quickly would be useful. A quickly performed scan correspondingly decreases the amount of thermal energy absorbed by the anodes which may desirably reduce anode size. The present invention contemplates a new, improved x-ray tube assembly and method of x-ray generation which overcomes the above difficulties and others.

BRIEF SUMMARY OF THE INVENTION

In accordance with the present invention, an x-ray tube includes a body defining a vacuum envelope. A plurality of anode elements disposed within the vacuum tube each define at least one target face. A plurality of cathode assemblies are mounted within the vacuum envelope for generating an electron beam directed toward an associated target face.

In accordance with another aspect of the present invention, a plurality of x-ray beams are generated by the electron beams striking the associated target faces. The x-ray tube further includes a collimator disposed externally adjacent to the body defining a series of alternating openings and septa for collimating the generated x-rays into a plurality of parallel x-ray beams.

In accordance with another aspect of the present invention, the x-ray tube assembly further includes a filament current supply and a control circuit. The control circuit selectively electrically connects the filament current supply to the cathode assemblies.

In a more limited aspect of the present invention, the plurality of anodes each comprise two opposing target faces.

In accordance with the present invention, an x-ray tube includes an air evacuated body which defines an x-ray exit window. A multiplicity of cathode/anode pairs are disposed within the body for generating x-ray beams. The cathodes each generate an electron beam which travels along a preselected trajectory, with the anodes being displaced from each other along an axis. Each anode has at least one target face on which a focal spot is generated by the electron beam. Within the body, the anodes are rotatably mounted about the axis such that an annular area on the target face intersects the trajectory at a preselected distance from each cathode. Control circuitry selectively powers at least one cathode in response to a desired diagnostic imaging procedure.

In accordance with the present invention, an x-ray tube includes a vacuum envelope which defines an x-ray exit window elongated parallel to a primary axis. An anode assembly defines a plurality of annular target faces disposed generally transverse to the primary axis. A plurality of electron sources are also included for focusing electron beams on at least selected annular target faces to generate a plurality of x-ray beams. A drive is provided for rotating the anode assembly, and a collimator mounted adjacent to the x-ray window collimates the x-ray beams into a plurality of parallel slices.

In accordance with another aspect of the present invention, each anode assembly has two annular target faces on opposite sides. The electron sources include a plurality of cathode assemblies where each cathode assembly is disposed between adjacent target faces.

In accordance with the present invention, a method of generating a plurality of x-ray beams includes rotating a plurality of anode elements spaced along a common axis about the axis. A plurality of electron beams are concurrently generated and focused on at least selected anodes to generate x-rays.

In accordance with another aspect of the present invention, the generating and focusing steps include generating and focusing the electron beams onto a first subset of the anode elements. The generating and focusing of the electron beams onto the first subset of anode elements is terminated and electron beams are generated and focused onto a second subset of the anode elements.

One advantage of the present invention resides in improved anode loading by providing a larger focal track area with relatively small diameter anodes.

Another advantage of the present invention resides in enabling a plurality of parallel beams to be generated concurrently.

Another advantage of the present invention resides in reduced scan time for volume scans, making single rotation volume scans feasible.

Other benefits and advantages of the present invention will become apparent to those skilled in the art upon a reading and understanding of the preferred embodiments.

BRIEF DESCRIPTION OF THE DRAWINGS

The invention may take physical form in certain parts and arrangements of parts and in various steps and arrangements of steps. The drawings are only for purposes of illustrating the preferred embodiments and are not to be construed as limiting the invention.

DETAILED DESCRIPTION OF THE PREFERRED EMBODIMENT

Figure 1:
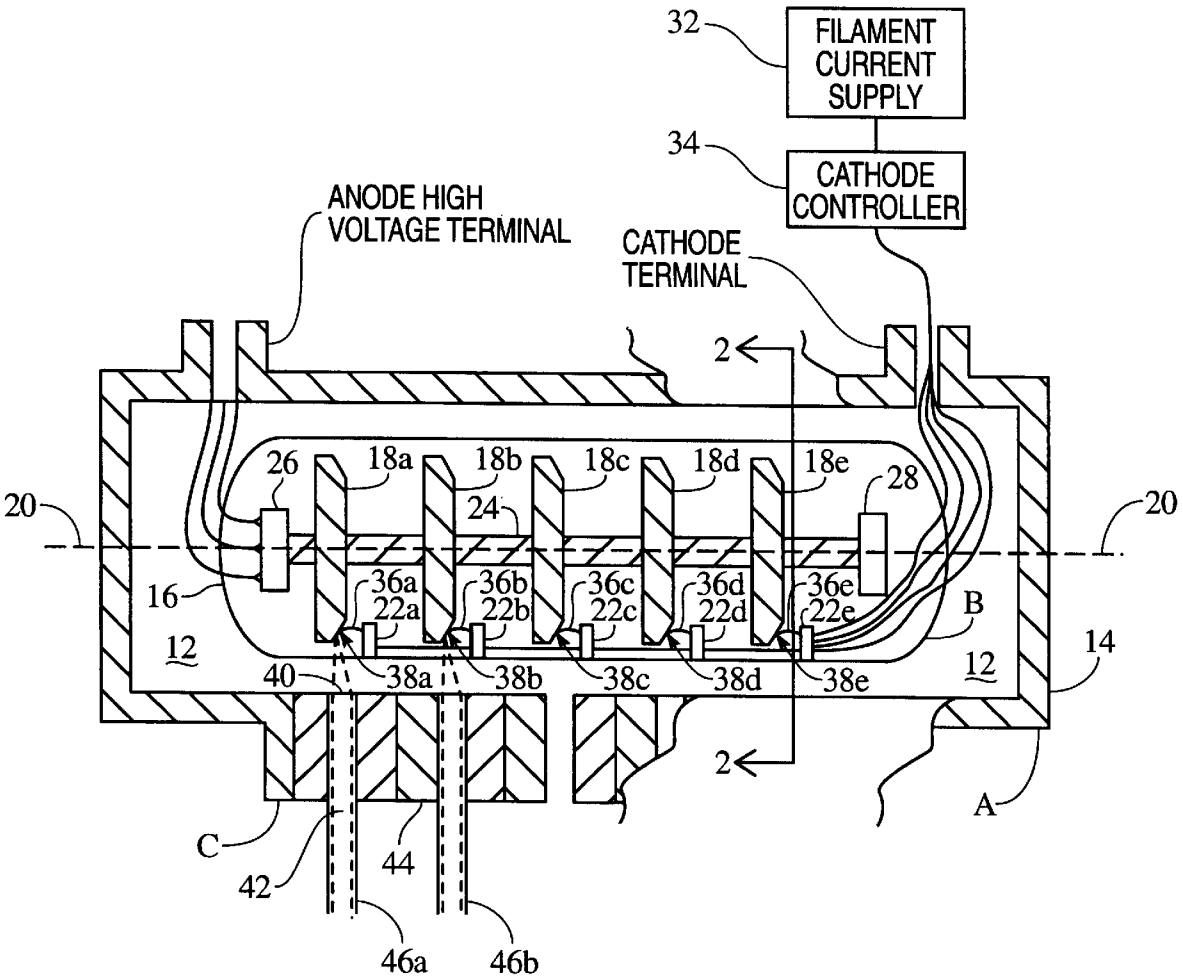
FIG. 1 illustrates a cross-sectional view of an x-ray tube with multiple simultaneously emitting focal spots in accordance with the present invention.

With reference to FIG. 1, a tube housing A holds a vacuum tube B and supports a collimator C. The housing A defines an interior cavity 12 surrounded by, preferably, a lead shielded tube housing 14. The vacuum tube B is mounted in the housing surrounded by cooling oil. The vacuum tube B includes a vacuum envelope 16 within which a plurality of anode disc elements 18*a*–18*e* are rotatably mounted. The anode disc elements 18 are preferably evenly separated along an axis 20. As will be more fully discussed below, also within the envelope 16 are a plurality of cathode assemblies 22*a*–22*e*. It is to be appreciated that while the five anode elements and cathode assemblies shown are presently preferred, any number of cathode/anode pairs is foreseen by the present invention.

A cylindrical rod or member 24 is held in place along axis 20. In the preferred embodiment, the rod 24 is attached to a rotating drive 26 on one end and a bearing or second motor assembly 28 on the other. The anode disc elements 18 are fixed at intervals along the rod 24. A filament current supply 32 is switchably connected by a cathode controller 34 to each of the cathode assemblies 22*a*–22*e* for heating selected ones of the cathode filaments to generate a cloud of electrons 36*a*–36*e* adjacent each heated cathode. Alternately, all the filaments may remain powered and a grid control switch may be incorporated into the cathode control assemblies to cut off the electron streams from the cathode to the anode elements. A high voltage supply (not shown) is applied across the anode elements and cathodes to propel the electron beams 36*a*–36*e* to strike the anodes at a focal spots or areas 38*a*–38*e* which causes the generation of heat energy and x-rays. The present invention also recognizes the desirability of individually powering selected anode elements in response to the desired imaging profile.

Figure 2:
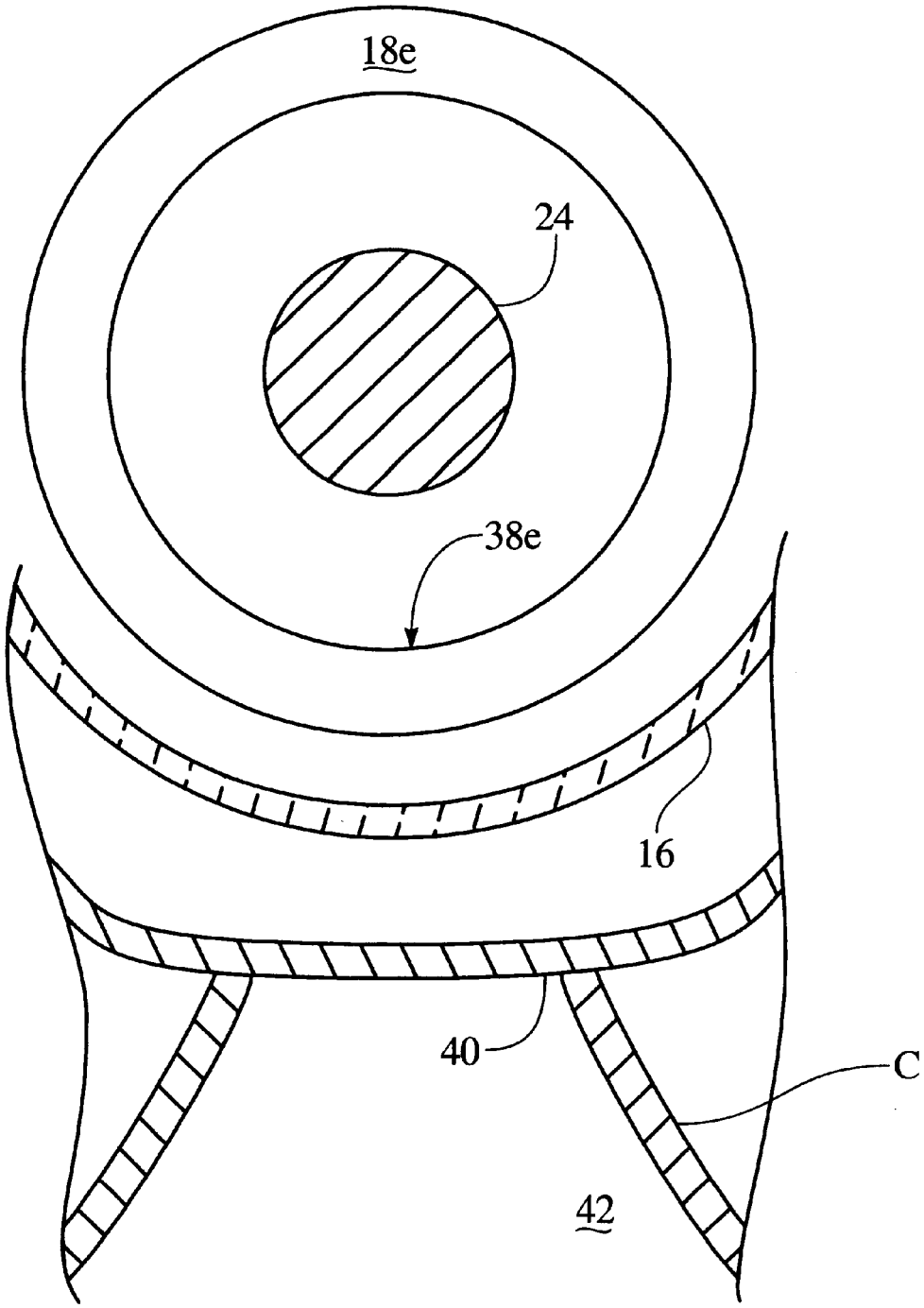
FIG. 2 is a transverse view taken along line 2—2 from FIG. 1.

With reference to FIGS. 1 and 2, the collimator C is attached to the tube housing 14 which includes an x-ray window 40. The collimator defines a fan-shaped opening 42 and a plurality of axially spaced septa 44. The x-rays 46*a*, 46*b*, . . . emanating from each anode 18 are collimated by the fan-shaped divergent walls that define the openings 42 into a fan shaped beam that is calibrated to the volume to be scanned. The septa collimate the beams into a plurality of parallel x-ray slices 46 spaced along, and in a plane perpendicular to axis 20.

Figure 3:
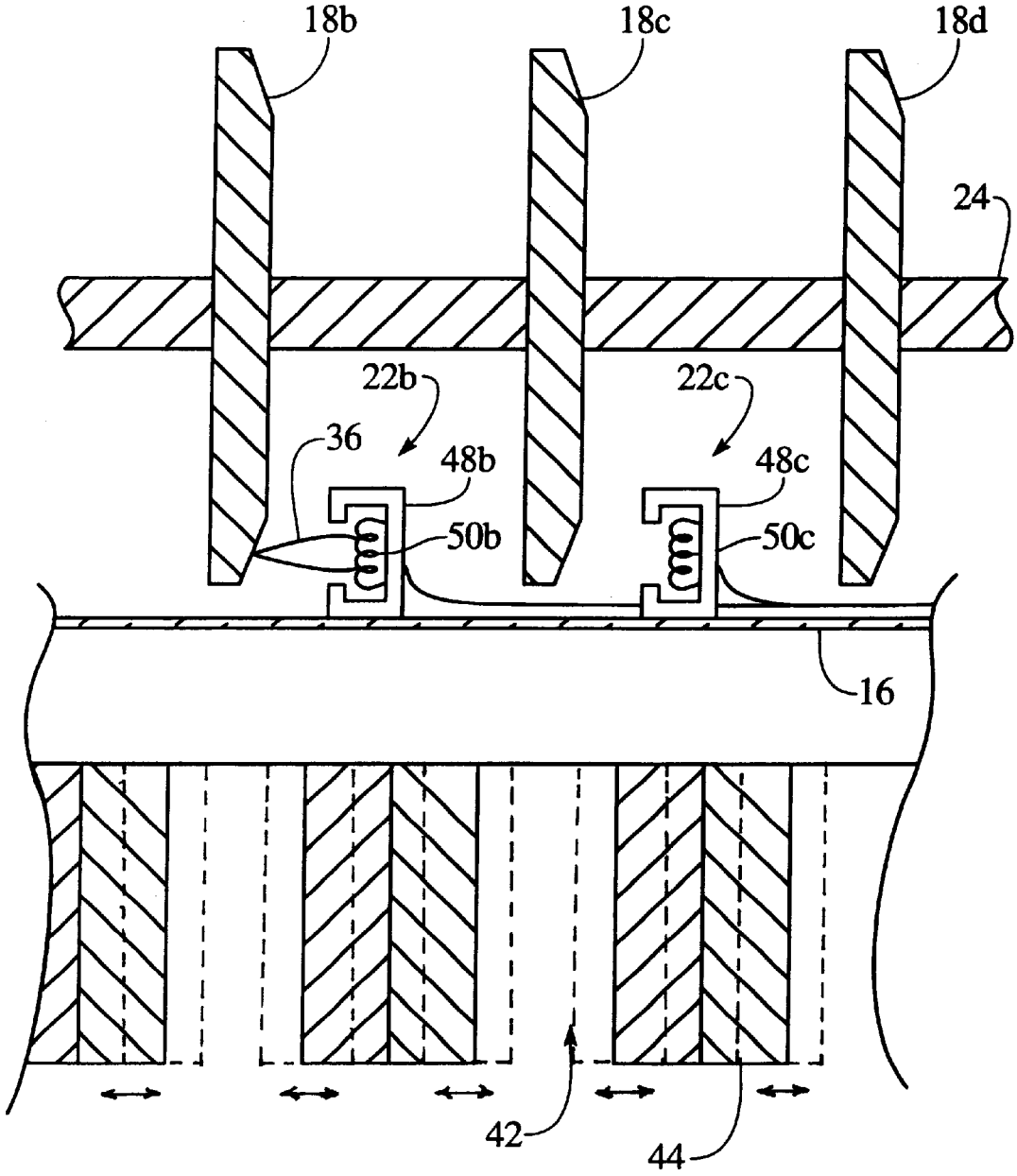
FIG. 3 shows a more detailed portion of the structure as illustrated in FIG. 1.

With reference to FIG. 3, each of the cathode assemblies 22 includes an electron beam focusing cup 48*a*–48*e* in which the filaments 50*a*–50*e* are mounted. The cups 48 are negatively charged to define a preselected trajectory for the electron beams 36.

Figure 4:
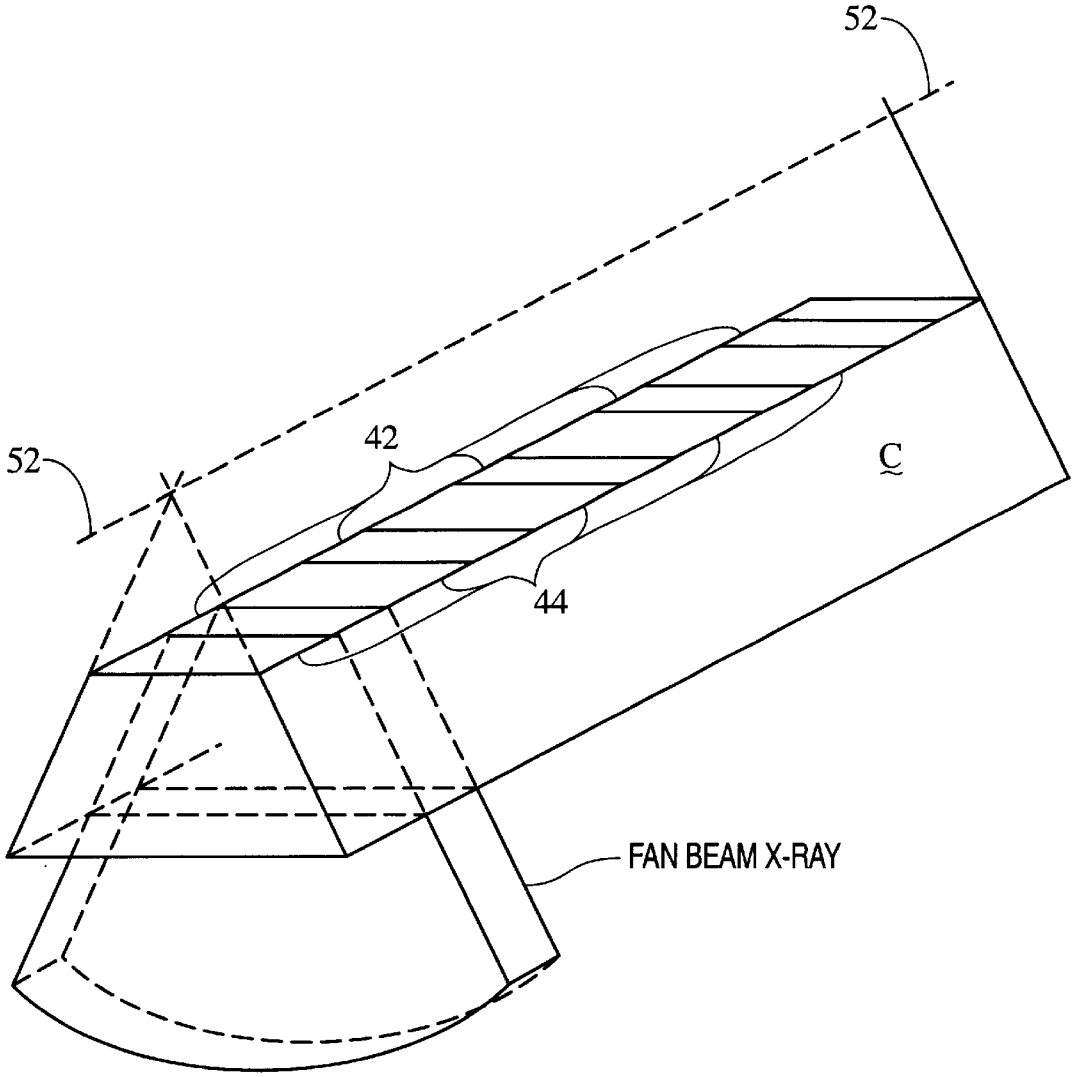
FIG. 4 isolates a collimator suitable for the present invention.

With reference to FIG. 4, the collimator preferably has a trapezoidal cross-section formed as a section of an equilateral triangle having an apex along a line 52 connecting the focal spots 36*a*–36*e* of the anode elements 18. Moreover, it can be appreciated that the trapezoidal openings 42 alternate with the septa 44. In an alternate embodiment shown in FIG. 3, the septa 44 are independently positionable to define independently adjustable width trapezoidal openings 42, where desired, for diagnostic imaging procedures.

Figure 5:
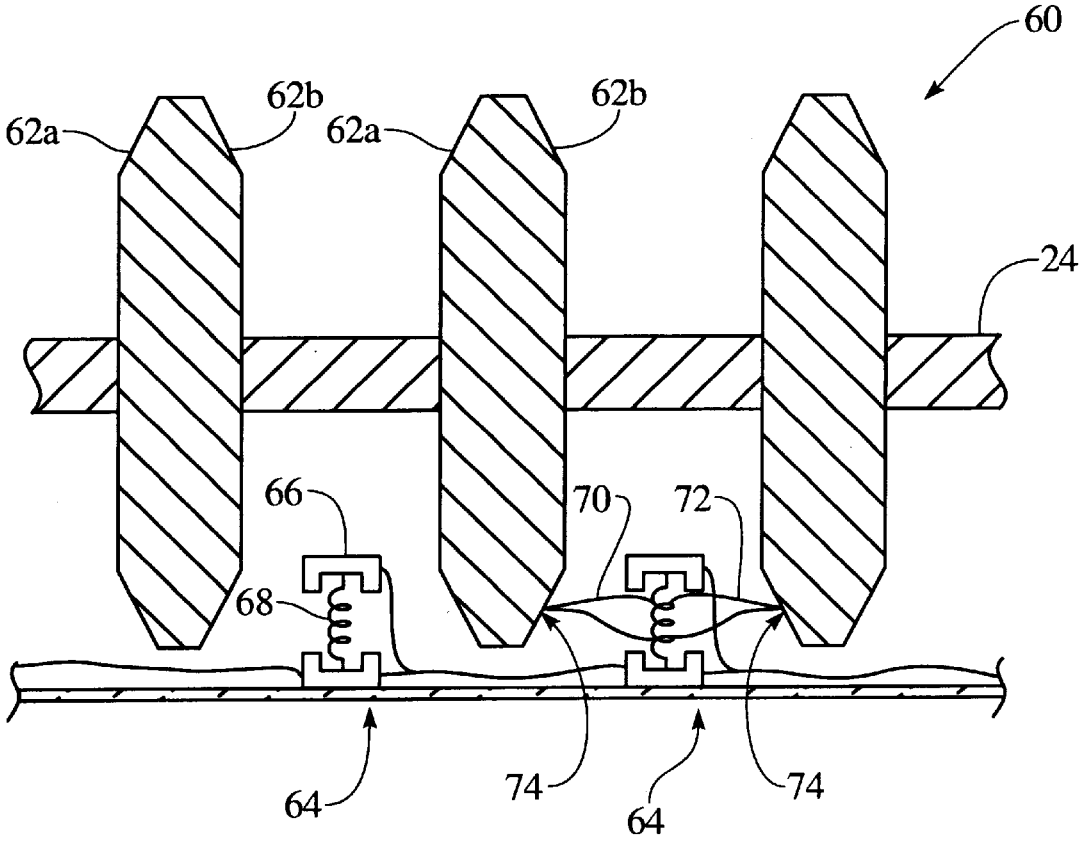
FIG. 5 details an alternate anode-cathode configuration in accordance with the present invention.

Referring now to FIG. 5, the plurality of anode elements 60 are analogous to those of FIG. 1, except each of the anode elements 60 define two opposing target faces 62*a*, 62*b*. The cathodes 64 include a common cathode cup 66 with a common filament 68. Beams of electrons 70, 72 are focused onto the pair of adjacent target faces 62*a*, 62*b*. A focal spot 74 is generated on each anode face 62*a*, 62*b* where the electron beam trajectory strikes.

Figure 6:
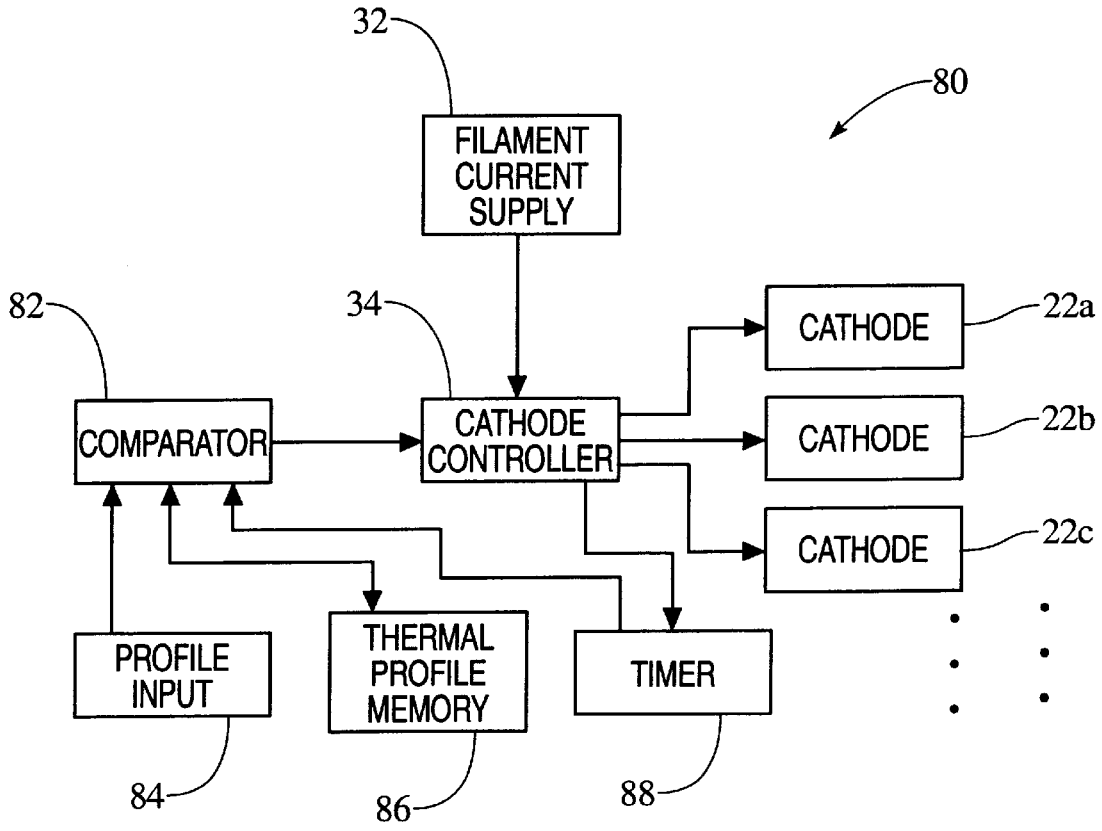
FIG. 6 is a block diagram of an exemplary control circuit.

Referring now to FIG. 6 the x-ray tube assembly preferably includes a control circuit 80 for selectively powering the cathode assemblies 22. A cathode controller 34 is electrically connected between the filament current supply 32 and the individual cathode assemblies 22*a*, 22*b*, . . . . A comparator 82 signals the cathode controller 34 based on selected inputs. The selected inputs include a profile input 84, a thermal profile memory or look up table 86, and a timer 88. The profile input 84 is preferably an input source where a technician can select a desired imaging pattern based on diagnostic needs. For example, the profile input desired may be for all cathode/anode pairs to be used simultaneously to provide a maximum number of image slices in the shortest time. On the other hand, the desired profile may be to alternate or cycle selected sub-sets of cathode/anode pairs, perhaps to cover a larger volume.

As a further example, the technician may desire a maximum number of slices within the temperature envelope of the x-ray tube assembly. In this event, the thermal profile memory 86 is accessed to estimate the time that the target faces can be bombarded with electrons before a period of rest, or non-use must occur to facilitate removal of excess thermal energy. The memory 86 is preloaded with thermal curves specific to the anode elements of the tube. Then when the tubes are powered, a timer 88 calculates the amount of time the individual cathodes have been on. This time allows the comparator to estimate thermal loading conditions of the anode elements in use by plotting the time onto the thermal profile memory.

Regardless of profile desired, the comparator 82 receives the inputs, determines the sequence of operation and signals the controller 34 to individually select specific cathode assemblies 22.

The invention has been described with reference to the preferred embodiments. Potential modifications and alterations will occur to others upon a reading and understanding of the specification. It is our intention to include all such modifications and alterations insofar as they come within the scope of the appended claims, or the equivalents thereof.

Having thus described the preferred embodiments, I now claim my invention to be:

1. An x-ray tube assembly comprising:

a body defining a vacuum envelope;

a plurality of anode disks disposed within the vacuum envelope, each anode disk defining at least one annular target face; and a plurality of cathode assemblies mounted within the vacuum envelope for generating an electron beam directed toward an associated target face.

2. The x-ray tube assembly as set forth in claim 1 wherein a plurality of x-ray beams are generated by the electron beams striking the associated target faces, the x-ray tube further including:

a collimator disposed externally adjacent to the body defining a series of alternating openings and septa for collimating generated x-rays into a plurality of parallel x-ray beams.

3. The x-ray tube assembly as set forth in claim 2 wherein the septa are adjustable for forming x-ray beams having selected thicknesses.

4. The x-ray tube assembly as set forth in claim 1 wherein the plurality of anode disks are evenly displaced along an axis.

5. An x-ray tube assembly comprising:

a body defining a vacuum envelope;

a plurality of anode elements disposed within the vacuum envelope, each anode element defining at least one target face, the plurality of anode elements being evenly displaced along an axis;

a rotating drive operatively connected to the plurality of anode elements for rotating the anode elements about the axis;

a plurality of cathode assemblies mounted within the vacuum envelope which generate electron beams directed toward associated target faces.

6. The x-ray tube assembly as set forth in claim 1 further including:

a filament current supply; and a control circuit selectively electrically connecting the filament current supply to the cathode assemblies.

7. An x-ray tube assembly comprising:

a body defining a vacuum envelope;

a plurality of anode elements disposed within the vacuum envelope, each anode element defining at least one target face; and a plurality of cathode assemblies mounted within the vacuum envelope for generating an electron beam directed toward an associated target face;

a cathode current supply; and a control circuit selectively electrically connecting the cathode current supply to the cathode assemblies, the control circuit including:

a timer which times a length of time the cathode assemblies have been powered;

a thermal loading memory which stores a time/temperature curve for the anodes; and a comparator which applies the length of time to the time/temperature curve to provide a determined thermal loading condition, the comparator comparing the determined thermal loading condition with a desired imaging profile and controlling a switch electrically connected between the cathode assemblies and the cathode current supply.

8. The x-ray tube assembly as set forth in claim 1 including:

a filament current supply; and a grid control element and associated circuitry that selectively switches on and off electron beams to the anode disk.

9. The x-ray tube as set forth in claim 1 wherein the plurality of anode disks each include:

two opposing target faces.

10. An x-ray tube assembly comprising:

an air evacuated body which defines an x-ray exit window;

a multiplicity of cathode/anode pairs disposed within the body for generating x-ray beams, the cathodes each generating an electron beam which travels along a preselected trajectory, the anodes being displaced from each other along an axis, each anode having at least one target face on which a focal spot is generated by the electron beam, the anodes being rotatably mounted about the axis within the body such that a circular annulus on the target face intersect the trajectory at a preselected distance from each cathode; and a selection circuit for selectively powering at least one of the cathodes in response to a desired diagnostic imaging procedure.

11. The x-ray tube assembly as set forth in claim 10 further including:

a collimator adjacent to the x-ray exit window, the collimator having a trapezoidal cross section for collimating the x-ray beams transaxially, and having a plurality of septa for collimating the x-ray beams axially.

12. The x-ray tube assembly as set forth in claim 11 wherein the axial septa are adjustable to adjust beam width.

13. An x-ray tube assembly comprising:

a vacuum envelope which defines an x-ray exit window elongated parallel to a primary axis;

an anode assembly which defines a plurality of annular target faces disposed generally transverse to the primary axis;

a plurality of electron sources for focusing electron beams on at least selected ones of the annular target faces to generate a plurality of x-ray beams;

a drive for rotating the anode assembly; and a collimator mounted adjacent the x-ray window for collimating the x-ray beams into a plurality of parallel slices.

14. The x-ray tube assembly as set forth in claim 13 wherein the anode assembly includes:

a plurality of anode element disks each having at least one of the annular target faces;

a central shaft extending parallel to the primary axis, the anode disks being mounted to the central shaft at intervals, the drive being connected to the shaft for rotating the shaft and the anode element disks.

15. The x-ray tube assembly as set forth in claim 14 wherein the electron sources include:

a cathode assembly disposed adjacent each annular target face.

16. The x-ray tube assembly as set forth in claim 14 wherein:

each anode element disk has two annular target faces on opposite sides thereof: and the electron sources include a plurality of cathode assemblies, each cathode assembly being disposed between adjacent annular target faces.

17. A method of generating a plurality of x-ray beams comprising:

(a) rotating a plurality of anode elements spaced along a common axis about the axis;

(b) concurrently generating a plurality of electron beams; and (c) focusing the electron beams on at least selected anode elements to generate x-rays.

18. The method of generating x-rays as set forth in claim 17 further including:

(d) collimating the x-rays produced into a plurality of parallel fan-shaped x-ray beams.

19. The method of generating x-rays as set forth in claim 18 where the generating and focusing steps include:

generating and focusing the electron beams onto a first subset of the anode elements; and terminating the generating and focusing of the electron beams onto the first subset of the anode elements and commencing generating and focusing electron beams onto a second subset of the anode elements.

* * * * *